US011482385B2

(12) United States Patent
Maladen et al.

(10) Patent No.: US 11,482,385 B2
(45) Date of Patent: Oct. 25, 2022

(54) OPTIMIZED CURRENT SWITCH ON POWER LINE

(71) Applicant: Schneider Electric Industries SAS, Rueil Malmaison (FR)

(72) Inventors: Romain Maladen, Sinard (FR); Jérôme Douchin, Claix (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/491,559

(22) Filed: Oct. 1, 2021

(65) Prior Publication Data

US 2022/0108849 A1 Apr. 7, 2022

(30) Foreign Application Priority Data

Oct. 7, 2020 (FR) ..... FR2010244

(51) Int. Cl.
*H01H 1/14* (2006.01)
*H01H 3/38* (2006.01)

(52) U.S. Cl.
CPC ..... *H01H 1/14* (2013.01); *H01H 3/38* (2013.01); *H01H 2235/01* (2013.01)

(58) Field of Classification Search
CPC ..... H01H 1/14; H01H 3/38; H01H 33/00; H01H 2235/01; H01H 33/12
USPC ..... 200/48 R, 239
See application file for complete search history.

(56) References Cited

U.S. PATENT DOCUMENTS 10,818,452 B1 * 10/2020 Hendrix ..... H01H 33/121
10,867,758 B2 * 12/2020 Bianco ..... H01H 9/547
10,886,076 B2 * 1/2021 Jenichen ..... H01H 3/605

FOREIGN PATENT DOCUMENTS

WO 2020025242 A1 2/2020
WO WO2020025242 * 2/2020 ..... H01H 31/28

OTHER PUBLICATIONS

French Search Report and Written Opinion dated Jun. 22, 2021 for corresponding French Patent Application No. FR2010244, 8 pages.

* cited by examiner

*Primary Examiner* — Edwin A. Leon
*Assistant Examiner* — Iman Malakooti
(74) *Attorney, Agent, or Firm* — Locke Lord LLP

(57) ABSTRACT

A current switch arranged between a first power line segment and a second power line segment, including: a first switch element, including a main contact and a secondary contact rigidly connected to the main contact, mounted so as to be mobile on the first power line segment so as to follow a separating travel between a closed position and an open position and a second switch element mounted so as to be freely mobile on the second power line segment and forced towards a rest position by elastic loading.

12 Claims, 12 Drawing Sheets

OPTIMIZED CURRENT SWITCH ON POWER LINE

TECHNICAL FIELD

The present disclosure relates to the field of current switches on a power cable or line.

PRIOR ART

A high- or medium-voltage power line is commonly equipped with a switch. Such a power line is intended to transmit a current through a distribution network, from a voltage source to the consumer. The switch allows the current through the line to be interrupted or established, by opening or conversely by closing the line. The switch can allow an intervention on the line in order to manage electricity flows. In association with a fuse, it may also allow a malfunction in the network, a short circuit for example, to be removed.

Conventionally, the switch comprises two contacts which are mutually mobile between a joining position, corresponding to the closure of the line, and a separating position, corresponding to the opening of the line. The two contacts are separated in an insulating medium, in order to extinguish an electric arc that occurs as the contacts are separated.

In medium-voltage and high-voltage lines, the insulating medium is commonly sulfur hexafluoride $SF_6$. However, this gas has the drawback of being a greenhouse gas, the use of which is extremely harmful for the environment.

Thus, there exist switches equipped with vacuum bottles, in which the contacts are separated in vacuum. This solution specifically allows the electric arc to be extinguished without requiring the use of polluting gases. However, the vacuum bottle has a high production cost.

Additionally, there are also devices capable of separating the contacts in air. However, the architecture of such a device is either bulky and quite expensive, or does not provide electrical endurance, corresponding to a number of successive opening operations, that meets the requirements of the market.

The present disclosure aims to provide a switch that allows switching of the current in lines with relatively high voltage which does not have the drawbacks mentioned above.

SUMMARY

To that end, the present invention provides a current switch arranged between a first power line segment and a second power line segment, comprising:

- a first switch element comprising a main contact and a secondary contact rigidly connected to the main contact, mounted so as to be mobile on the first power line segment so as to follow a separating travel between a closed position and an open position, the main contact being arranged so as to:
  - be in electrical contact with the second power line segment when said first switch element is between said closed position and an intermediate opening state between said closed position and said open position,
  - no longer be in electrical contact with the second power line segment when said first switch element is between said intermediate opening state and said open position; and

- a second switch element mounted so as to be freely mobile on the second power line segment and forced towards a rest position by elastic loading;

in which the secondary contact of the first switch element is designed to:

- cooperate with the second switch element so as to move the second switch element against said elastic loading in a first portion of said separating travel from the closed position to a release state between said intermediate opening state and said open position,
- not interfere with the second switch element in a second portion of said separating travel between said release state and the open position, so that the second switch element is then brought back to the rest position by said elastic loading.

Thus, advantageously, the elastic loading on the second switch element allows the second switch element to move in opposition to the movement of the first switch element when the contacts are separated. The elastic loading on the second switch element then contributes to the rapid separation of the contacts and allows the electric arc to be extinguished. It is therefore no longer necessary to use a vacuum bottle, while still retaining high performance in terms of interrupting the current. Additionally, the switch requires few moving parts to operate, and it may be easily arranged between two segments of the line.

The features disclosed in the following paragraphs may, optionally, be implemented. They may be implemented independently of one another or in combination with one another:

- the second switch element is mounted so as to pivot on the second segment of the line, about a first pivoting axis;
- the first switch element is mounted so as to pivot on the first power line segment, about a second pivoting axis;
- the first pivoting axis is parallel to the second pivoting axis;
- the second switch element comprises a blade extending along a general plane that is substantially perpendicular to the first pivoting axis and a pin protruding from the blade parallel to the first pivoting axis and designed to cooperate with the secondary contact of the first switch element;
- the secondary contact of the first switch element extends along a general plane that is substantially perpendicular to the first pivoting axis, the secondary contact having a first cam edge designed to cooperate with said pin through cam effect during said separating travel;
- the blade of the second switch element extends between a first end close to the first pivoting axis and a second, free end, said pin being arranged close to said second end of the blade, and in which the secondary contact of the first switch element extends between a first end close to the second pivoting axis and a second, free end, said cam edge being arranged close to said second end of the secondary contact;
- the first switch element is also designed to move from said open position to the closed position along a closing travel, and in which the secondary contact has a second cam edge, designed to cooperate with said pin through cam effect during said closing travel, so as to temporarily move the second switch element away from the rest position during the passage of said secondary contact;
- the second cam edge or a segment of the pin intended to come into contact with the second cam edge is electrically insulating;

the secondary contact and the second switch element are arranged between two electrically insulating panels which extend perpendicular to the first pivoting axis, the two electrically insulating panels covering at least the second end of the first blade and the second end of the secondary contact when the first switch element is in the release state;

the first switch element is controlled by an actuator;

one from among the first power line segment and the second power line segment is connected to a voltage source, and the other from among the first power line segment and the second power line segment extends to a point of consumption.

BRIEF DESCRIPTION OF THE DRAWINGS

Other features, details and advantages will become apparent from reading the description provided below and from examining the appended drawings, in which.

DESCRIPTION OF THE EMBODIMENTS

In the various figures, identical references denote identical or similar elements.

Figure 1:
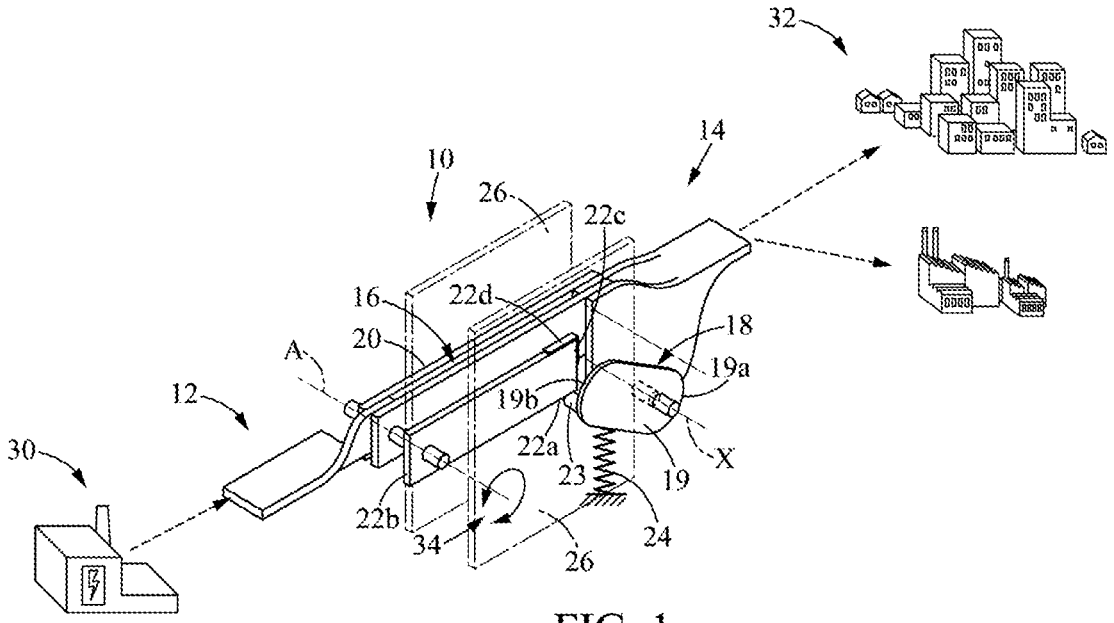
FIG. 1 schematically shows a perspective view of an exemplary switch in a closed position.

FIG. 1 illustrates a switch 10 mounted on a medium- or high-voltage power line. Hereinafter, the terms "medium voltage" and "high voltage" are used as commonly accepted, namely with the term "medium voltage" referring to a voltage which is higher than 1000 volts AC and 1500 volts DC, but not higher than 52 000 volts AC and 75 000 volts DC, while the term "high-voltage" refers to a voltage which is strictly higher than 52 000 volts AC and 75 000 volts DC. Such a power line is intended to transmit a current through a distribution network, from a voltage source 30 to a place of consumption 32. The place of consumption 32 may for example be a dwelling or an industrial plant.

As illustrated, the switch 10 is mounted between a first segment 12 of the line and a second segment 14 of the line. In this instance, the first segment 12 goes to the voltage source 30, and the second segment 14 extends to the place of consumption 32. Alternatively, the second segment 14 could go to the voltage source 30, and the first segment 12 could extend to the place of consumption 32. The switch 10 may close the line, allowing the current to flow between the two segments 12, 14 of the line. The switch 10 may also open the line, interrupting the flow of the current between the two segments 12, 14 of the line.

The switch 10 essentially comprises a first switch element 16 and a second switch element 18, both made of electrically conductive material.

The first switch element 16 is mounted so as to be mobile on the first segment 12 of the line. The first switch element 16 may then adopt a closed position and a open position. In the closed position, the first switch element 16 makes contact with the second segment 14 of the line. The line is closed, and the current may flow through the first switch element 16 to reach the second segment 14 of the line. Conversely, in the open position, the first switch element 16 is separated from the second segment 14 of the line. The line is open, and the flow of the current between the first and second segments 12, 14 of the line is interrupted. A separating travel corresponds to the transition of the first switch element 16 from the closed position to the open position. A closing travel corresponds to the transition of the first switch element 16 from the open position to the closed position.

The first switch element 16 is here mounted so as to rotate about a pivoting axis A. The axis A is substantially perpendicular to the general plane of extension of the first switch element 16. Thus, a separating travel corresponds here to a rotation of the first switch element 16 about the axis A. A closing travel corresponds here to a rotation of the first switch element 16 about the axis A, in the direction opposite the separating travel.

The first switch element 16 may be controlled by an actuator 34. The actuator 34 may in particular control the opening of the line when a malfunction is detected on the network or when an intervention has to be performed on the line.

Figure 2:
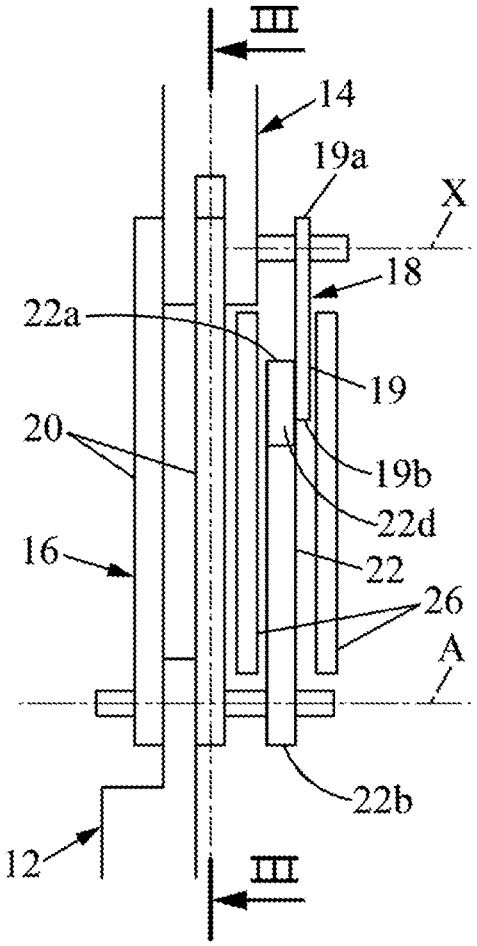
FIG. 2 schematically shows a top view of the switch of FIG. 1.
Figure 3:
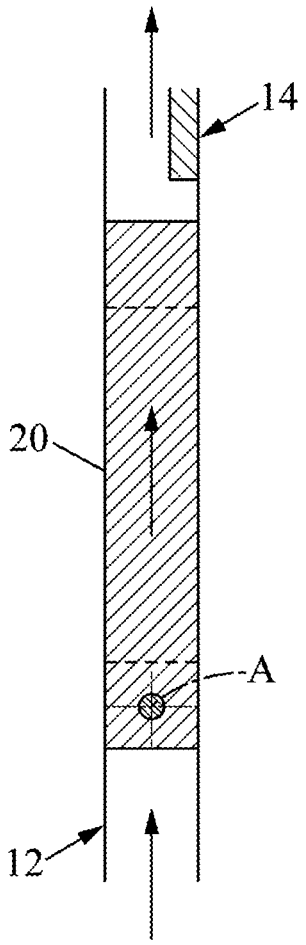
FIG. 3 schematically shows a sectional view of FIG. 2, along an axis III-III.
Figure 4:
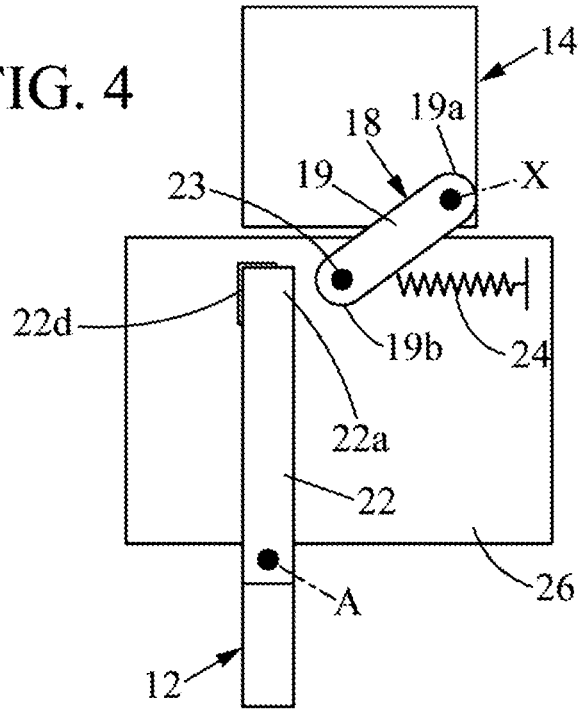
FIG. 4 schematically shows a side view of FIG. 1.
Figure 5:
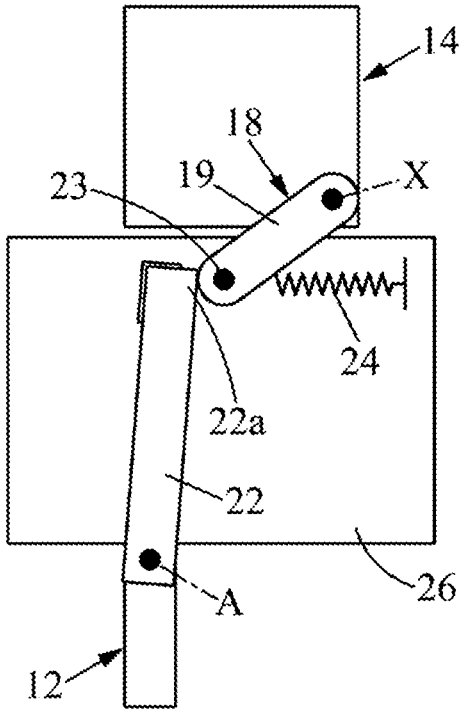
FIG. 5 schematically shows a side view of the switch of FIG. 1 in a first intermediate position between the closed position and an open position.

As can be seen in FIGS. 1 and 2, the first switch element 16 comprises a main contact 20 and a secondary contact 22.

The main contact 20 extends between the first and second segments 12, 14 of the line to come into contact with the second segment 14 of the line. The cross section of the main contact 20 is designed to fit onto the second segment 14 of the line. Additionally, the area of the cross section of the main contact 20 is sufficient to withstand continuous flow of the current. Thus, the main contact 20 forms a main path for the flow of current between the segments 12, 14 of the line.

The secondary contact 22 is rigidly connected to the main contact 20. The secondary contact 22 extends parallel to the main contact 20 from an end 22*b* mounted on the first segment 12 of the line to a free end 22*c*. The free end 22*c* of the secondary contact 22 is intended to load the second switch element 18 during the separating travel and the closing travel. When the secondary contact 22 touches the second switch element 18, the secondary contact 22 and the second switch element 18 form a secondary path for the flow of current between the segments 12, 14 of the line. The secondary path for the flow of current makes it possible in particular to increase the capability of switching an electric arc formed on separation of the main contact 20 and of the second segment of the line 14 during the separating travel.

In practice, the free end 22*c* of the secondary contact 22 has a first cam profile 22*a* in order to drive the second switch element 18 through cam effect during the separating travel. The free end 22*c* also comprises a second cam profile 22*d* in order to move the second switch element 18 through cam effect during the closing travel. The second cam profile 22*d* may in particular be made of an electrically insulating material. The insulation makes it possible to prevent the flow of current via the secondary path for the flow of current during the closing travel, so as to protect the auxiliary contact 22 from a short circuit during the closure of the line.

The second switch element 18 is mounted so as to be mobile on the second segment 14 of the line. The second switch element 18 extends between the second segment 14 of the line until close to the free end 22*c* of the secondary contact 22 of the first switch element 16. The second switch element 18 forms an obstacle to the passage of the secondary contact 22, so as to be driven by the secondary contact 22 during the separating travel and the closing travel.

The second switch element 18 is here mounted so as to rotate about a pivoting axis X on the second segment 14 of the line. The axis X is parallel to the axis A of rotation of the first switch element 16. The movement of the second switch element 18 then corresponds to a rotation of the second switch element 18 about the axis X. The driving of the second switch element 18 by the secondary contact 22 of the first switch element 16 corresponds to a rotation in the direction opposite the rotation of the first switch element 16.

The second switch element 18 is attached to a loading element 24. The loading element 24 takes here the form of a spring 24. The spring 24 may in particular be a compression spring or a torsion spring. The spring 24 forces the second switch element 18 towards a rest position, in which the second switch element 18 is oriented towards the first segment 12 of the line. The driving of the second switch element 18 by the secondary contact 22 of the first switch element 16 acts against the spring 24, so as to move the second switch element 18 out of the rest position. Following separation of the second switch element 18 and of the secondary contact 22, the spring 24 returns the second switch element 18 to the rest position. The contacts 16, 18 then move in opposite directions. The relative speeds of the second switch element 18 and of the first switch element 16 make it possible to increase the capability of switching an electric arc 28. The electric arc 28 is in particular formed between the second switch element 18 and the secondary contact 22 of the first switch element 16 during a separating travel.

As illustrated, the second switch element 18 comprises here a blade 19 and a pin 23.

The blade 19 extends in a plane substantially normal to the axis X. The blade 19 is then parallel to the secondary contact 22 of the first switch element 16. The blade 19 extends between an end 19*a* close to the axis A and a free end 19*b* close to the free end 22*c* of the secondary contact 22 of the first switch element 16.

The pin 23 of the blade 19 is located close to the free end 19*b* of the blade 19. The pin 23 extends perpendicular to the blade 19, in the direction of the secondary contact 22 of the first switch element 16. The pin 23 is intended to cooperate with the first and second cam edges 22*a*, 22*d* provided on the end 22*c* of the auxiliary contact 22 of the first switch element 16.

A portion of the pin 23 intended to come into contact with the cam edge 22*d* of the auxiliary contact 22 may be made of an electrically insulating material. The insulation makes it possible to prevent the flow of current via the secondary path for the flow of current during the closing travel. Alternatively, the pin 23 may be devoid of electrically insulating material. The insulation may then be provided by the cam edge 22*d* of the secondary contact 22.

Additionally, the second switch element 18 and the secondary contact 22 of the first switch element 16 may be arranged between two panels made of insulating material 26, for example of plastic material, in particular of polyoxymethylene (POM) or of polytetrafluoroethylene (PTFE). Thus, the switching of the arc 28 formed on separation of the contacts 16, 18 is improved.

Hereinafter, the operation of the switch 10 is described in greater detail.

Initially, as can be seen in FIGS. 1 to 4, the first switch element 16 is in the closed position. The line is closed. The main contact 20 of the first switch element 16 connects the first segment 12 of the line and the second segment 14 of the line. The current may reach the second segment 14 of the line via the main path for the flow of current. The second switch element 18 is elastically forced towards the rest position. The second switch element 18 is then forced towards the free end 22*c* of the blade 22 of the first switch element 16.

The separating travel may be controlled by the actuator 34. The first switch element 16 is here controlled so as to rotate about the axis A.

During a first portion of the separating travel, the first switch element 16, in particular the secondary contact 22, comes into contact with, and then drives, the second switch element 18.

Figure 6:
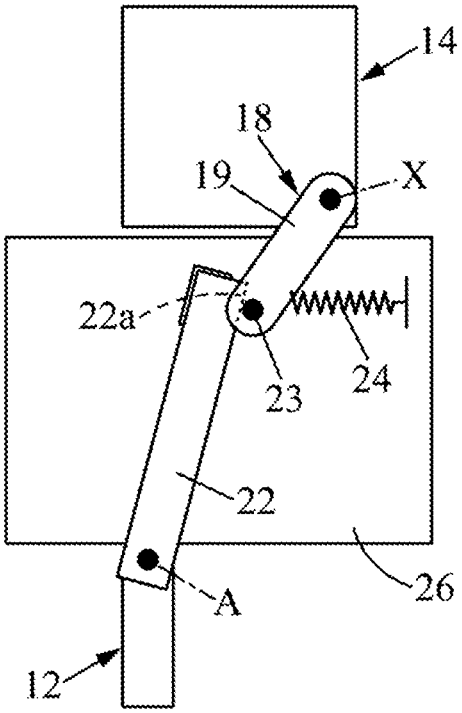
FIG. 6 schematically shows a side view of the switch of FIG. 1 in a second intermediate position between the closed position and the open position.

As illustrated in FIG. 6, contact occurs when the cam edge 22*a* of the secondary contact 22 of the first switch element 16 touches the pin 23 of the second switch element 18. The electric current may reach the second segment 14 of the line via the secondary path for the flow of current. Contact occurs while the main contact 20 of the first switch element 16 still touches the second segment 14 of the line, such that the electric current may also reach the second segment 14 of the line via the main path for the flow of current. The flow of the current is shared between the main path and the secondary path according to the electrical resistances of each of the paths for the flow of current. In this instance, the cross section of the main contact 20, which is larger than that of the auxiliary contact 22 and of the second switch element 18, leads the majority of the current via the main path for the flow of current.

Figure 7:
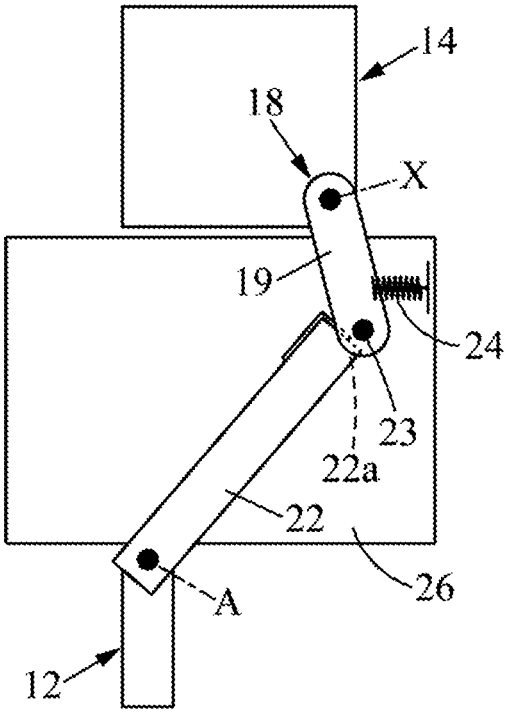
FIG. 7 schematically shows a side view of the switch of FIG. 1 in a third intermediate position between the closed position and the open position.

As can be seen in FIGS. 6 and 7, the driving of the second switch element 18 corresponds to rotation of the second switch element 18 about the axis X. The cam edge 22*a* of the secondary contact 22 of the first switch element 16 drives the pin 23 of the second switch element 18 through cam effect. The driving of the second switch element 18 acts against the elastic loading 24 acting on the second switch element 18. Here, the spring 24 is compressed.

When the first switch element 16 reaches an intermediate opening state, the main contact 20 of the first switch element 16 is separated from the second segment 14 of the line. An electric arc is formed between the main contact 20 and the second segment 14 of the line. The second switch element 18 is still in contact with the secondary contact 22 of the first switch element 16, such that the current may still reach the second segment 14 of the line via the secondary path for the flow of current. A switching of the current towards the secondary path for the flow of current is caused by the electrical impedance of the arc.

The first switch element 16 continues the rotation about the axis A and drives the second switch element 18. The first switch element 16 is moved away from the second segment 14 of the line. The distancing increases the impedance of the electric arc between the main contact 20 and the second segment 14 of the line. Together with the electrical resistance provided by the secondary path for the flow of the current, the electric arc between the main contact 20 and the second segment 14 of the line may be interrupted without damaging the ends of the main contact 20 and the second segment 14 of the line.

Figure 8:
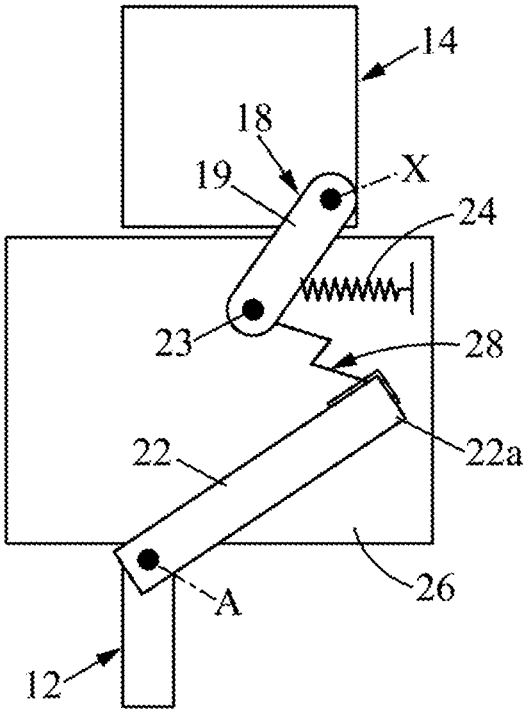
FIG. 8 schematically shows a side view of the switch of FIG. 1 in a fourth intermediate position between the closed position and the open position.

When the first switch element 16 reaches a release state, illustrated in FIG. 8, the second switch element 18 is separated from the first switch element 16. The current can no longer reach the second segment 14 of the line. The electric arc 28 is formed between the end 22*c* of the secondary contact 22 of the first switch element 16 and the end 19*b* of the blade 19 of the second switch element 18.

During a second portion of the separating travel, the first switch element 16 continues the rotation about the axis A. The second switch element 18 is returned to the rest position by the elastic loading 24. Here, the return force of the spring 24 drives the rotation of the second switch element 18 about the axis X, in the direction opposite the rotation of the first switch element 16. The second switch element 18 moves away from the secondary contact 22 of the first switch element 16. More specifically, the end 19*b* of the blade 19 of the second switch element 18 and the end 22*c* of the secondary contact 22 of the first switch element 16 are moved away from one another. The relative speeds of the second switch element 18 and of the first switch element 16 make it possible to increase the capability of switching and therefore to rapidly extinguish the electric arc 28.

Figure 9:
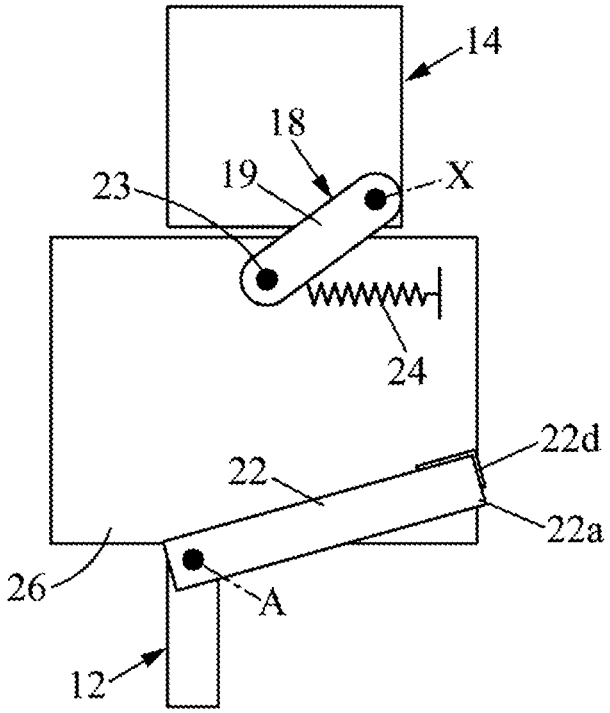
FIG. 9 schematically shows a side view of the switch of FIG. 1 in the open position.

When the first switch element 16 reaches the open position, illustrated in FIG. 9, the line is open. The first switch element 16 is away from the second segment 14 of the line. The second switch element 18 is in the rest position.

The closing travel may also be controlled by the actuator 34. The first switch element 16 is controlled so as to rotate about the axis A in the direction opposite the separating travel.

Figure 10:
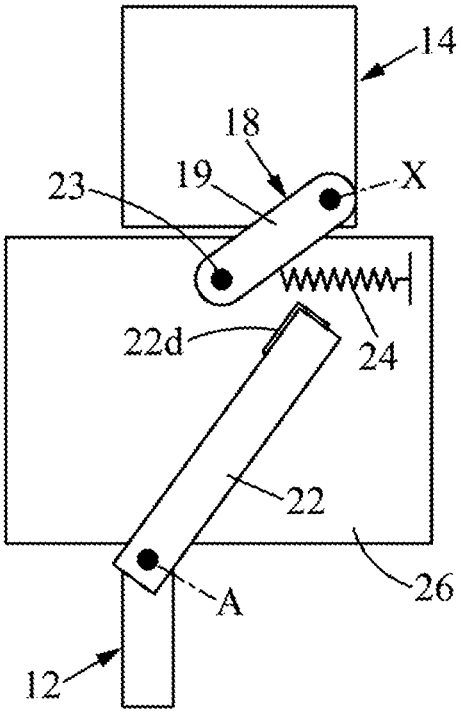
FIG. 10 schematically shows a side view of the switch of FIG. 1 in a first intermediate position between the open position and the closed position.

During a first portion of the closing travel, the first switch element 16 comes closer to the second segment 14 of the line. The second switch element 18 is in the rest position, as can be seen in FIG. 10.

During a second portion of the closing travel, the first switch element 16 continues the rotation about the axis A and comes into contact with, and then moves, the second switch element 18.

Figure 11:
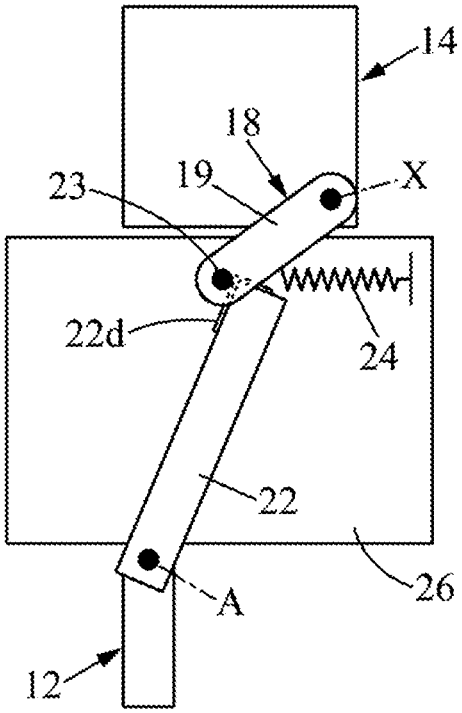
FIG. 11 schematically shows a side view of the switch of FIG. 1 in a second intermediate position between the open position and the closed position.
Figure 12:
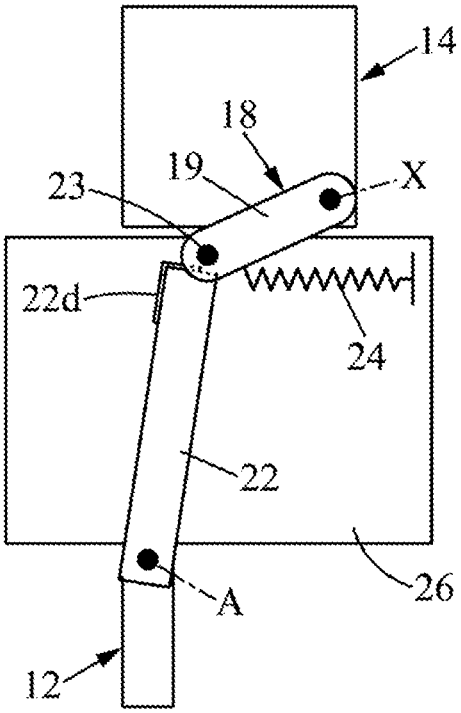
FIG. 12 schematically shows a side view of the switch of FIG. 1 in a third intermediate position between the open position and the closed position.

As illustrated in FIG. 11, contact occurs when the cam edge 22*d* of the secondary contact 22 of the first switch element 16 touches the pin 23 of the second switch element 18. The electrically insulating material of a portion of the pin 23 and/or of the cam edge 22*d* of the secondary contact 22 makes it possible to prevent the establishment of the current via the secondary path for the flow of current.

The movement of the second switch element 18 corresponds to rotation of the second switch element 18 about the axis X. The cam edge 22*d* of the blade 22 of the first switch element 16 drives the pin 23 of the second switch element 18 through cam effect. The secondary contact 22 of the first switch element 16 may then come closer to the second segment 14 of the line without being blocked by the second switch element 18.

The main contact 20 of the first switch element 16 touches the second segment 14 of the line. The current may once again reach the second segment 14 of the line via the main path for the flow of current. The first switch element 16 releases the second switch element 18. The second switch element 18 is brought back to the rest position by the elastic loading 24. The line then returns to the closed position of FIGS. 1 and 4.

The invention claimed is:

1. A current switch arranged between a first power line segment and a second power line segment, comprising:

a first switch element comprising a main contact and a secondary contact rigidly connected to the main contact, mounted so as to be mobile on the first power line segment so as to follow a separating travel between a closed position and an open position, the main contact being arranged so as to:

be in electrical contact with the second power line segment when said first switch element is between said closed position and an intermediate opening state between said closed position and said open position, no longer be in electrical contact with the second power line segment when said first switch element is between said intermediate opening state and said open position; and a second switch element mounted so as to be mobile on the second power line segment and forced towards a rest position by elastic loading;

wherein the secondary contact of the first switch element is designed to:

cooperate with the second switch element so as to move the second switch element against said elastic loading in a first portion of said separating travel from the closed position to a release state between said intermediate opening state and said open position, not interfere with the second switch element in a second portion of said separating travel between said release state and the open position, so that the second switch element is then brought back to the rest position by said elastic loading;

and wherein the second switch element and the secondary contact of the first switch element are arranged between two panels made of insulating material.

2. The switch according to claim 1, wherein the second switch element is mounted so as to pivot on the second segment of the line, about a first pivoting axis.

3. The switch according to claim 1, wherein the first switch element is mounted so as to pivot on the first power line segment, about a second pivoting axis.

4. The switch according to claim 2, wherein the first switch element is mounted so as to pivot on the first power line segment, about a second pivoting axis, and wherein the first pivoting axis is parallel to the second pivoting axis.

5. The switch according to claim 4, wherein the second switch element comprises a blade extending along a general plane that is substantially perpendicular to the first pivoting axis and a pin protruding from the blade parallel to the first pivoting axis and designed to cooperate with the secondary contact of the first switch element.

6. The switch according to claim 5, wherein the secondary contact of the first switch element extends along a general plane that is substantially perpendicular to the first pivoting axis, the secondary contact having a first cam edge designed to cooperate with said pin through cam effect during said separating travel.

7. The switch according to claim 6, wherein the blade of the second switch element extends between a first end close to the first pivoting axis and a second, free end, said pin being arranged close to said second end of the blade, and wherein the secondary contact of the first switch element extends between a first end close to the second pivoting axis and a second, free end, said cam edge being arranged close to said second end of the secondary contact.

8. The switch according to claim 7, wherein the first switch element is also designed to move from said open position to the closed position along a closing travel, and wherein the secondary contact has a second cam edge, designed to cooperate with said pin through cam effect during said closing travel, so as to temporarily move the second switch element away from the rest position during the passage of said secondary contact.

9. The switch according to claim 8, wherein the second cam edge and/or a segment of the pin intended to come into contact with the second cam edge is electrically insulating.

10. The switch according to claim 7, wherein the two electrically insulating panels extend perpendicular to the first pivoting axis, the two electrically insulating panels covering at least the second end of the first blade and the second end of the secondary contact when the first switch element is in the release state.

11. The switch according to claim 1, wherein the first switch element is controlled by an actuator.

12. The switch according to claim 1, wherein one from among the first power line segment and the second power line segment is connected to a voltage source, and the other from among the first power line segment and the second power line segment extends to a point of consumption.

* * * * *